US008373643B2

(12) United States Patent
Zhao et al.

(10) Patent No.: US 8,373,643 B2
(45) Date of Patent: Feb. 12, 2013

(54) FREQUENCY SYNTHESIS AND SYNCHRONIZATION FOR LED DRIVERS

(75) Inventors: Bin Zhao, Irvine, CA (US); Andrew M. Kameya, Irvine, CA (US); Victor K. Lee, Irvine, CA (US)

(73) Assignee: Freescale Semiconductor, Inc., Austin, TX (US)

( * ) Notice: Subject to any disclaimer, the term of this patent is extended or adjusted under 35 U.S.C. 154(b) by 1167 days.

(21) Appl. No.: 12/244,796

(22) Filed: Oct. 3, 2008

(65) Prior Publication Data

US 2010/0085295 A1 Apr. 8, 2010

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS

| | | | | |
|---|---|---|---|---|
| 4,162,444 | A | 7/1979 | Rodgers | |
| 4,615,029 | A | 9/1986 | Hu et al. | |
| 4,649,432 | A | 3/1987 | Watanabe et al. | |
| 4,686,640 | A | 8/1987 | Simison | |
| 4,907,862 | A * | 3/1990 | Suntola | 349/61 |
| 5,025,176 | A | 6/1991 | Takeno | |
| 5,038,055 | A | 8/1991 | Kinoshita | |
| 5,508,909 | A | 4/1996 | Maxwell et al. | |
| 5,668,611 | A * | 9/1997 | Ernstoff et al. | 348/771 |
| 5,723,950 | A | 3/1998 | Wei et al. | |
| 5,844,540 | A * | 12/1998 | Terasaki | 345/102 |
| 5,898,329 | A | 4/1999 | Hopkins | |
| 6,281,822 | B1 | 8/2001 | Park | |
| 6,864,641 | B2 | 3/2005 | Dygert | |
| 6,937,084 | B2 | 8/2005 | Bowling | |
| 6,943,500 | B2 | 9/2005 | LeChevalier | |

(Continued)

FOREIGN PATENT DOCUMENTS

| | | | |
|---|---|---|---|
| JP | 2003332624 | A | 11/2003 |
| JP | 2005116199 | A | 4/2005 |

(Continued)

OTHER PUBLICATIONS

Susumu Tadakuma et al, "improved PWM Control for GTO Inverters with Pulse Number Modulation", IEEE Transactions on Industry Applications, IEEE Service Center, Piscataway, NJ, US, vol. 32, No. 3, Jun. 1, 1996.*

(Continued)

*Primary Examiner* — Dorothy Harris

(57) ABSTRACT

A PWM generation module generates a PWM data signal used to control a light emitting diode (LED) driver for one or more strings of LEDs of a display device. The PWM data signal is synchronized with the frame boundaries of the video content being displayed. The PWM generation module can configure the PWM data signal such that a new PWM cycle is initiated at the start of each successive frame, and further whereby those PWM cycles that would be prematurely terminated at frame boundaries are instead driven at a constant reference level until the frame boundary. With this configuration, a substantially linear average light intensity can be achieved across frames, thereby reducing or eliminating display distortion that is often present in other PWM cycle synchronization techniques. The PWM generation module can use a self-learning process to make adjustments to the expected number of completeable PWM cycles per frame in response to dynamic changes in the frame rate, PWM frequency, or other related display parameters.

20 Claims, 6 Drawing Sheets

U.S. PATENT DOCUMENTS

| | | | | |
|---|---|---|---|---|
| 6,995,592 | B2 | 2/2006 | Agarwal | |
| 7,106,294 | B2 * | 9/2006 | Kumamoto et al. | 345/102 |
| 7,126,397 | B1 | 10/2006 | Mok | |
| 7,176,948 | B2 * | 2/2007 | Lewis | 345/691 |
| 7,262,724 | B2 | 8/2007 | Hughes et al. | |
| 7,391,280 | B2 | 6/2008 | Hsu | |
| 7,436,378 | B2 | 10/2008 | Ito et al. | |
| 7,511,545 | B1 | 3/2009 | Kesler | |
| 7,550,932 | B2 * | 6/2009 | Kung et al. | 315/307 |
| 7,593,243 | B2 | 9/2009 | Ganev et al. | |
| 7,741,885 | B1 | 6/2010 | Guo et al. | |
| 7,800,415 | B2 | 9/2010 | Yedevelly et al. | |
| 2004/0008159 | A1 * | 1/2004 | Cunha et al. | 345/30 |
| 2004/0208011 | A1 | 10/2004 | Horiuchi et al. | |
| 2004/0232964 | A1 | 11/2004 | Wiktor et al. | |
| 2004/0233144 | A1 | 11/2004 | Rader et al. | |
| 2004/0251942 | A1 | 12/2004 | Chiu et al. | |
| 2005/0275355 | A1 * | 12/2005 | Samuelsson | 315/307 |
| 2006/0064609 | A1 | 3/2006 | Bryan | |
| 2006/0164142 | A1 | 7/2006 | Stanley | |
| 2006/0186830 | A1 | 8/2006 | Shami et al. | |
| 2007/0080911 | A1 | 4/2007 | Liu et al. | |
| 2007/0182701 | A1 * | 8/2007 | Kim et al. | 345/102 |
| 2007/0253330 | A1 | 11/2007 | Tochio et al. | |
| 2008/0054815 | A1 | 3/2008 | Kotikalapoodi | |
| 2008/0074381 | A1 * | 3/2008 | Kumamoto | 345/102 |
| 2008/0297067 | A1 | 12/2008 | Wang et al. | |
| 2009/0073735 | A1 | 3/2009 | Kesler | |
| 2009/0128045 | A1 | 5/2009 | Szczeszynski et al. | |
| 2009/0187925 | A1 | 7/2009 | Hu et al. | |
| 2009/0230874 | A1 | 9/2009 | Zhao et al. | |
| 2009/0230891 | A1 | 9/2009 | Zhao et al. | |
| 2009/0273288 | A1 | 11/2009 | Zhao et al. | |
| 2009/0315481 | A1 | 12/2009 | Zhao | |
| 2010/0026203 | A1 | 2/2010 | Zhao et al. | |

FOREIGN PATENT DOCUMENTS

WO WO 2008 124718 A2 * 10/2008

OTHER PUBLICATIONS

Feng et al, "A new switched-capacitor frequency modulated driver for light emitting diodes", Review of Scientific Instruments 78, 114701 (2007).*

PCT Search Report mailed Mar. 28, 2011 for International Application No. PCT/US2010/044067, 3 pages.

Mc Nerney, Tim, "constant-current power supply for Luxeon 5W LED with low-voltage warning and shut-off Software Documentation, as shipped to Mali in first 45 prototypes," Nov. 2004, www.designthatmatters.org/ke/pubs/kled-doc.txt, 5 pages.

Maxim: "Application Note 810, Understanding Flash ADCs," Oct. 2, 2001, 8 pages.

National Semiconductor Data Sheet: "LM3432/LM3432B 6-Channel Current Regulator for LED Backlight Application," May 22, 2008, pp. 1-18.

U.S. Appl. No. 12/537,443, filed Aug. 7, 2009, entitled Pulse Width Modulation Frequency Conversion.

U.S. Appl. No. 12/703,239, filed Feb. 10, 2010, entitled "Pulse Width Modulation With Effective High Duty Resolution".

U.S. Appl. No. 12/537,692, filed Aug. 7, 2009, entitled "Phase-Shifted Pulse Width Modulation Signal Generation".

U.S. Appl. No. 12/625,818, filed Nov. 25, 2009, entitled "Synchronized Phase-Shifted Pulse Width Modulation Signal Generation".

U.S. Appl. No. 12/703,249, filed Feb. 10, 2010, entitled "Duty Transition Control in Pulse Width Modulation Signaling".

Luke Huiyong Chung, Electronic Products: "Driver ICs for LED BLUs," May 1, 2008, 3 pages.

Akira Takahashi, Electronic Products: "Methods and features of LED drivers," Mar. 2008, 3 pages.

U.S. Appl. No. 12/340,985, filed Dec. 22, 2008, entitled "LED Driver With Feedback Calibration".

U.S. Appl. No. 12/326,963, filed Dec. 3, 2008, entitled "LED Driver With Precharge and Track/Hold".

U.S. Appl. No. 12/367,672, filed Feb. 9, 2009, entitled "Configuration for Dynamic Power Control in LED Displays".

U.S. Appl. No. 12/424,326, filed Apr. 15, 2009, entitled "Peak Detection With Digital Conversion".

U.S. Appl. No. 12/504,841, filed Jul. 17, 2009, entitled "Analog-To-Digital Converter With Non-Uniform Accuracy".

U.S. Appl. No. 12/690,972, filed Jan. 21, 2010, entitled "Serial Cascade of Minimum Tail Voltages of Subsets of LED Strings for Dynamic Power Contrl in LED Displays".

U.S. Appl. No. 12/363,607, filed Jan. 30, 2009, entitled "LED Driver With Dynamic Headroom Control".

International Application No. PCT/US2009/035284, Search Report and Written Opinion, Oct. 28, 2009, 11 pages.

Texas Instruments Publication, "Interleaved Dual PWM Controller with Programmable Max Duty Cycle," SLUS544A, (UCC28220, UCC28221) Sep. 2003, pp. 1-28.

Notice of Allowance mailed Oct. 5, 2010 for U.S. Appl. No. 12/537,692, 13 pages.

U.S. Appl. No. 13/025,201, filed Feb. 11, 2011 entitled, "Phase-Shifted Pulse Width Modulation Signal Generation Device and Method Therefor".

Notice of Allowance mailed Dec. 29, 2011 for U.S. Appl. No. 12/703,249, 24 pages.

Non-Final Office Action mailed Oct. 20, 2011 for U.S. Appl. No. 12/537,443, 22 pages.

Notice of Allowance mailed Jan. 25, 2012 for U.S. Appl. No. 12/537,443, 18 pages.

Notice of Allowance mailed Mar. 22, 2012 for U.S. Appl. No. 12/625,818, 25 pages.

Notice of Allowance mailed Jun. 8, 2012 for U.S. Appl. No. 12/537,443, 11 pages.

* cited by examiner

FREQUENCY SYNTHESIS AND SYNCHRONIZATION FOR LED DRIVERS

FIELD OF THE DISCLOSURE

The present disclosure relates generally to light emitting diodes (LEDs) and more particularly to pulse width modulation (PWM) for LED drivers.

BACKGROUND

Light emitting diodes (LEDs) often are used as light sources in liquid crystal displays (LCDs) and other displays. LED drivers for these displays often use pulse width modulation (PWM) signals to control the intensity of the light emitted by the LEDs while driving the LEDs at a fixed current, thereby achieving high color fidelity while varying intensity. However, video content is displayed as a series of frames, and if the PWM cycles of an LED driver are not carefully synchronized with the frame rate, visual noise, such as flickering, can occur at the display. One conventional synchronization scheme is to utilize a phase-locked loop (PLL) to directly synchronize the PWM cycles to the frame rate. However, PLLs are relatively expensive and complex to implement. Further, typical frame rates of 30 Hz to 120 Hz often are well below the effective reference frequency range of many PLL designs. For these applications, PLLs typically must have a very small loop bandwidth, leading to large components in the loop filter and a relatively long frequency locking time. These requirements often limit the suitability of conventional PWM synchronization techniques in video applications.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

Figure 1:
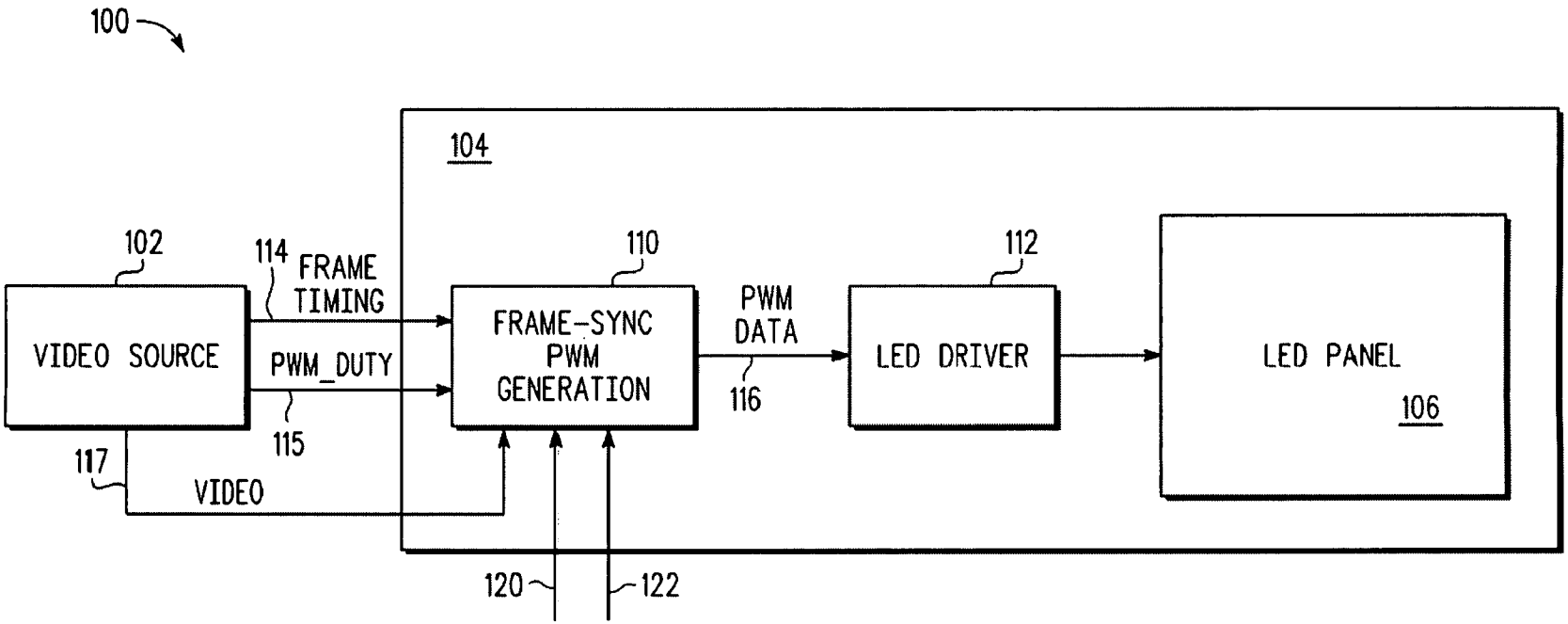
FIG. 1 is a diagram illustrating a light emitting diode (LED) system utilizing a frame-based pulse-width-modulation (PWM) synchronization scheme in accordance with at least one embodiment of the present invention.

FIGS. 1-6 illustrate example techniques for frame-based PWM cycle synchronization. A PWM generation module generates a PWM data signal used to control a light emitting diode (LED) driver for one or more strings of LEDs of a display device. The PWM data signal is synchronized with the frame boundaries of the video content being displayed. In one embodiment, the PWM generation module configures the PWM data such that a new PWM cycle is initiated at the start of each successive frame, and further whereby those PWM cycles that would be prematurely terminated at frame boundaries are instead driven at a constant reference level until the frame boundary. By configuring the PWM data signal in this manner, a substantially linear average light intensity can be achieved across frames, thereby reducing or eliminating display distortion that is often present in other PWM cycle synchronization techniques. In one embodiment, the PWM generation module uses an expected number of completeable PWM cycles per frame to decide when to initiate a constant-level PWM cycle in anticipation of a frame boundary. Further, the PWM generation module can use a self-learning process to make adjustments to the expected number of completeable PWM cycles per frame so as to improve the timing of the use of constant-level PWM cycles in the PWM data signal.

The term "completeable PWM cycle", as used herein, refers to a PWM cycle of a PWM data signal that would complete before a frame boundary (i.e., a PWM cycle that, given its complete duration, would not cross a frame boundary). The term "incompleteable PWM cycle", as used herein, refers to a PWM cycle of a PWM data signal that, given its complete duration, would not fully complete before a frame boundary (i.e., a PWM cycle that, if fully completed, would cross over a frame boundary). The term "incomplete PWM cycle", as used herein, refers to the duration or portion of an incompleteable PWM cycle that is prematurely terminated at a frame boundary. The term "constant-level PWM cycle," as used herein, refers to a PWM cycle that is driven at a constant reference level (e.g., ground/logic "0" or $V_{DD}$/logic "1") for its duration (full or prematurely terminated) regardless of the associated PWM duty ratio that normally is associated with the PWM cycle.

The techniques of the present disclosure are described in an example context whereby each PWM duty cycle initiates at a high level and then transitions to a low level after the corresponding duty ratio has been achieved (i.e., a "high-first" duty cycle). However, these techniques can be equally applied in a context whereby each PWM cycle initiates at a low level and then transitions to a high level to implement the corresponding duty ratio (i.e., a "low-first" duty cycle).

LCDs and other LED-based displays can operate in two PWM modes. In a first mode, the entire display frame is made available for PWM display (i.e., the PWM cycles can span the entire display frame duration). Thus, in this mode the active PWM period of the display frame is the entire display frame. However, the LEDs of LCD displays often exhibit a memory effect that can cause blurring in the displayed video. As such, it can be advantageous to "reset" the LEDs between each display frame by driving them with an increased current, thereby reducing the memory effect of the LEDs between display frames. Accordingly, in a second mode, the active PWM period is limited to only a portion of the display frame so that the remaining portion (the inactive PWM period) of the display frame duration can be used to perform a reset of the LEDs in preparation for the next display frame. Accordingly, for the first mode, the term "display frame" in relation to the PWM cycles refers to the entire display frame, and for the second mode, the term "display frame" in relation to the PWM cycles refers to the portion of the display frame that serves as the active PWM period of the display frame.

FIG. 1 illustrates a LED system 100 having frame-based PWM cycle synchronization in accordance with at least one embodiment of the present disclosure. The LED system 100 can include any of a variety of systems utilizing a LED-based display, such as a liquid crystal display (LCD) computer monitor or LCD television, a cellular phone, a personal digital assistant (PDA), a global-positioning system (GPS)-based navigation unit, an automotive display interface, and the like.

In the depicted example, the LED system 100 includes a video source 102 and a display device 104. The display device 104 includes an LED panel 106, a frame-synchronized (frame-sync) PWM generation module 110, and an LED driver 112. The video source 102 is configured to process video data to generate video signals to control the display device 104. The video source 102 can include, for example, a digital signal processor (DSP) configured to process video content encoded in accordance with one or more formats, such as an MPEG format, an H.264 format, a National Television Standards Committee (NTSC) format, a Phase Alternating Line (PAL) format, or a High Definition Television (HDTV) format. The video signals generated by the video source 102 include a frame timing reference 114, PWM duty data 115, as well as other video-related signaling (e.g., a pixel clock, pixel data, etc.). The frame timing reference 114 comprises digital or analog signaling representative of the timing of the frames (e.g., indicating the start of the display of each image frame) of the video content to be displayed at the LED panel 106 and is generated from the frame rate information associated with the video data. Examples of the frame rate information can include, for example, the Vertical Synchronization (VSYNC) signaling provided in NTSC, PAL, and HDTV systems, or the Vertical Blanking Interval used in Video Graphics Array (VGA)-based signaling and Digital Video Interface (DVI)-based signaling. The PWM duty data 115 represents the duty cycle ratio (variable or fixed) for the PWM cycles of each LED string or each set of LED strings of the LED panel 106. Additional signaling is generated in the LED system 100, including a PWM frequency indicator 120 that indicates the PWM cycle frequency (e.g., 240 PWM cycles per second) and a PWM resolution indicator 122 that indicates the step resolution of a PWM cycle (e.g., an 8-bit resolution or 255 ($2^8-1$) resolution steps. The PWM frequency indicator 120 can be generated in any of a variety of ways. To illustrate, a register, cache or memory can be used to store a value representative of a particular PWM frequency to be implemented, and thus the PWM frequency indicator 120 can be programmed by storing a particular value to the storage location corresponding to the PWM frequency indicator 120. Alternately, the PWM frequency indicator 120 can be programmed via a resistor or fuse. The PWM resolution indicator typically is application dependent, but in certain instances can be programmed in a similar manner.

The frame-sync PWM generation module 110 is configured to receive the frame timing reference 114, the PWM duty data 115, the PWM frequency indicator 120, and the PWM resolution indicator 122 and to generate a PWM data signal 116 that is synchronized to the frame rate represented in the frame timing reference 114 from these inputs. A single PWM data signal 116 can be used to drive all of the LED strings of the LED panel 106 (e.g., when driving a backlight panel of the LED panel). Alternately, the process of generating the PWM data signal 116 can be performed in parallel to generate a plurality of PWM data signals 116, each corresponding to a different set of one or more LED strings. For ease of convenience, a single PWM data signal 116 will be referenced herein, but the same principles apply for generating and processing a plurality of PWM data signals 116 for different LED strings of the LED display 106. Also for ease of illustration, the techniques of the present disclosure are described in an example context whereby the frame boundaries of the LED strings are synchronized (i.e., start simultaneous). However, it will be appreciated that it can be advantageous to offset or stagger the frame timings of the LED strings so as to reduce the instantaneous current load of the LED driver 112. The techniques disclosed herein apply equally to this staggered implementation.

As described in greater detail herein, the frame-sync PWM generation module 110 implements a technique whereby a new sequence of completeable PWM cycles is started at the start of each frame and whereby a constant reference level (e.g., a ground voltage or "0" volts) is driven on the PWM data signal 116 in place of incompleteable PWM cycles occurring at the ends of the sequences of completeable PWM cycles. The frame-sync PWM generation module 110 configures each completeable PWM cycle to have the PWM duty ratio identified by the PWM duty data 115. By providing a constant reference level for the PWM data signal 116 in place of an incompleteable PWM cycle, the display distortion exhibited by conventional PWM synchronization schemes can be reduced or eliminated. An example implementation of the frame-sync PWM generation module 110 and its related process are described below with reference to FIGS. 2-6.

The LED driver 112 is configured to drive an output voltage for one or more LED strings (of the LED panel 106) and control activation of the LED strings based on one or more PWM data signals 116 while regulating the current through the LED strings at a fixed current during the active portion of the corresponding PWM cycle (i.e., when the corresponding LED string is "on"). Typically, the LED driver 112 is configured to activate one or more LED strings when the PWM data signal 116 is at one reference level (e.g., $V_{DD}$ or logic "1") and to deactivate one or more strings of LEDs when PWM data signal 116 is at another reference level (e.g., ground or logic "0"). Thus the duty ratio of a PWM cycle of the PWM data signal 116 represents and controls the average intensity of the corresponding LED string over the PWM cycle, while regulating the current through the LED strings at or near a fixed current maintains the desired output for the LED strings. Example implementations of the LED driver are disclosed in U.S. patent application Ser. No. 12/056,237, entitled "LED Driver with Dynamic Power Management" and filed on Mar. 26, 2008, U.S. patent application Ser. No. 12/183,492, entitled "LED Driver with Frame-Based Dynamic Power Management" and filed on Jul. 31, 2008, and U.S. Patent Application Ser. No. 61/036,053, entitled "LED Driver with Dynamic Power Management" and filed on Mar. 12, 2008, the entireties of which are incorporated by reference herein.

Figure 2:
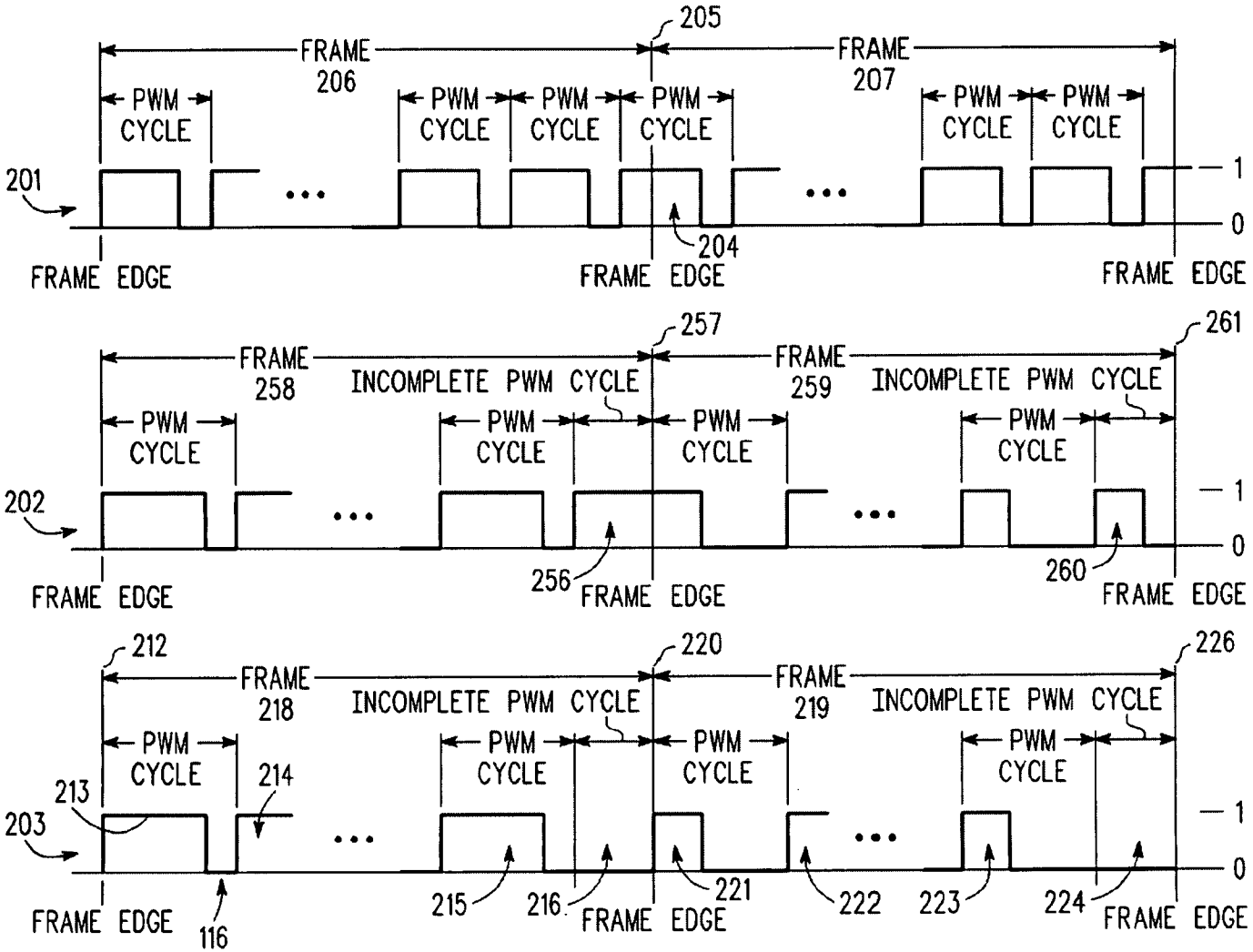
FIG. 2 is a diagram illustrating examples of conventional PWM synchronization schemes and an example of the frame-based PWM synchronization scheme in accordance with at least one embodiment of the present invention.

FIG. 2 is a set of charts illustrating examples of conventional PWM signaling (charts 201 and 202) and an example of the frame-based PWM synchronization technique utilized by the frame-sync PWM generation module 110 of FIG. 1 (chart 203) as described herein. Chart 201 illustrates a conventional PWM signaling scheme whereby no PWM cycle synchronization is utilized and, as a result, a PWM cycle 204 crosses a frame boundary 205 that marks the end of the display of a frame 206 and the start of the display of a frame 207. As noted above, this lack of synchronization can lead to visual artifacts due to the beating between the PWM signaling and the frame rate and its harmonics.

Chart 202 illustrates a conventional PWM signaling scheme whereby an incompleteable PWM cycle is prematurely terminated at a frame boundary 257 that marks the end of the display of a frame 258 and the start of the display of a frame 259, thereby resulting in an incomplete PWM cycle 256, and whereby an incompleteable PWM cycle is prematurely terminated at a frame boundary 261 that marks the end of the display of the frame 259 and the start of the display of the next frame (not shown), thereby resulting in an incomplete PWM cycle 260. Each incompleteable PWM cycle is generated in accordance with its corresponding PWM duty ratio. Accordingly, as illustrated by chart 202, the incomplete PWM cycle 256 is at a high reference level due to its high PWM duty ratio. In contrast, due to its low duty ratio, the incomplete PWM cycle 260 switches from the high reference to a low reference level before it is prematurely terminated changes. Thus, it will be appreciated that the average brightness of LED strings driven by the PWM signal of chart 202 is disproportionably greater for the frame 258 than for the frame 259 due to the difference between effective PWM duty ratios of the incomplete PWM cycles 256 and 260. This disproportionate change in average brightness over the frames can result in display distortion, thereby affecting viewing quality.

Chart 203 illustrates an example implementation of the frame-based PWM synchronization technique described herein. In the illustrated example, the PWM data signal 116 is configured such that a series of PWM cycles (e.g., PWM cycles 213, 214, 215) having a predetermined PWM duty ratio are driven on the PWM data signal 116 in response to a frame boundary 212 marking the start of the display of a frame 218. In one embodiment, the number of PWM cycles of the series is equal to a number of completeable PWM cycles expected to occur in the frame 218. As with the conventional technique illustrated by chart 202, the PWM synchronization technique of chart 203 starts the initial PWM cycle 213 of the series at the frame boundary 212. However, unlike the conventional technique whereby an incompleteable PWM cycle of the PWM data signal is permitted to continue up to the point of termination at the frame boundary in accordance with its associated PWM duty cycle, the PWM synchronization technique of chart 203 instead drives the PWM data signal 116 at a constant reference level (e.g., logic "0" or ground) for the duration of an incomplete PWM cycle 216 that starts at the end of the series of PWM cycles and that is terminated at the next frame boundary 220, regardless of the associated PWM duty ratio. Likewise, for a frame 219 initiated at the frame boundary 220, another series of PWM cycles 221, 222, and 223 having a predetermined PWM duty ratio is driven on the PWM data signal 116, whereby the number of PWM cycles of this series is equal to the number of completeable PWM cycles expected to occur for the frame 219. At the end of this series, the PWM data signal 116 is driven at the constant reference level for the duration of an incomplete PWM cycle 224 that starts at the end of the series and which is prematurely terminated by a frame boundary 226.

In other words, the PWM synchronization technique illustrated by chart 203 drives incompleteable PWM cycles at a fixed PWM duty ratio of 0% (regardless of the predetermined PWM duty ratio associated with the other PWM cycles of the frame) until they are terminated at the corresponding frame boundaries. In an alternate embodiment, rather than driving the PWM data signal 116 at a low reference level (e.g., logic "0" or ground) for the entire durations of incomplete PWM cycle, the PWM data signal 116 can instead be driven at a high reference level (e.g., logic "1" or $V_{DD}$) for the durations of incompleteable PWM cycles. That is, the PWM synchronization technique illustrated by chart 203 can instead drive incompleteable PWM cycles at a fixed PWM duty ratio of 100% until they are terminated at the corresponding frame boundaries.

By driving incompleteable PWM cycles at the end of a frame at a constant reference level, the PWM synchronization technique disclosed herein achieves substantial linearity of average light intensity between frames, thereby reducing or eliminating the potential for display distortion that otherwise often arises in conventional PWM synchronization techniques.

Figure 3:
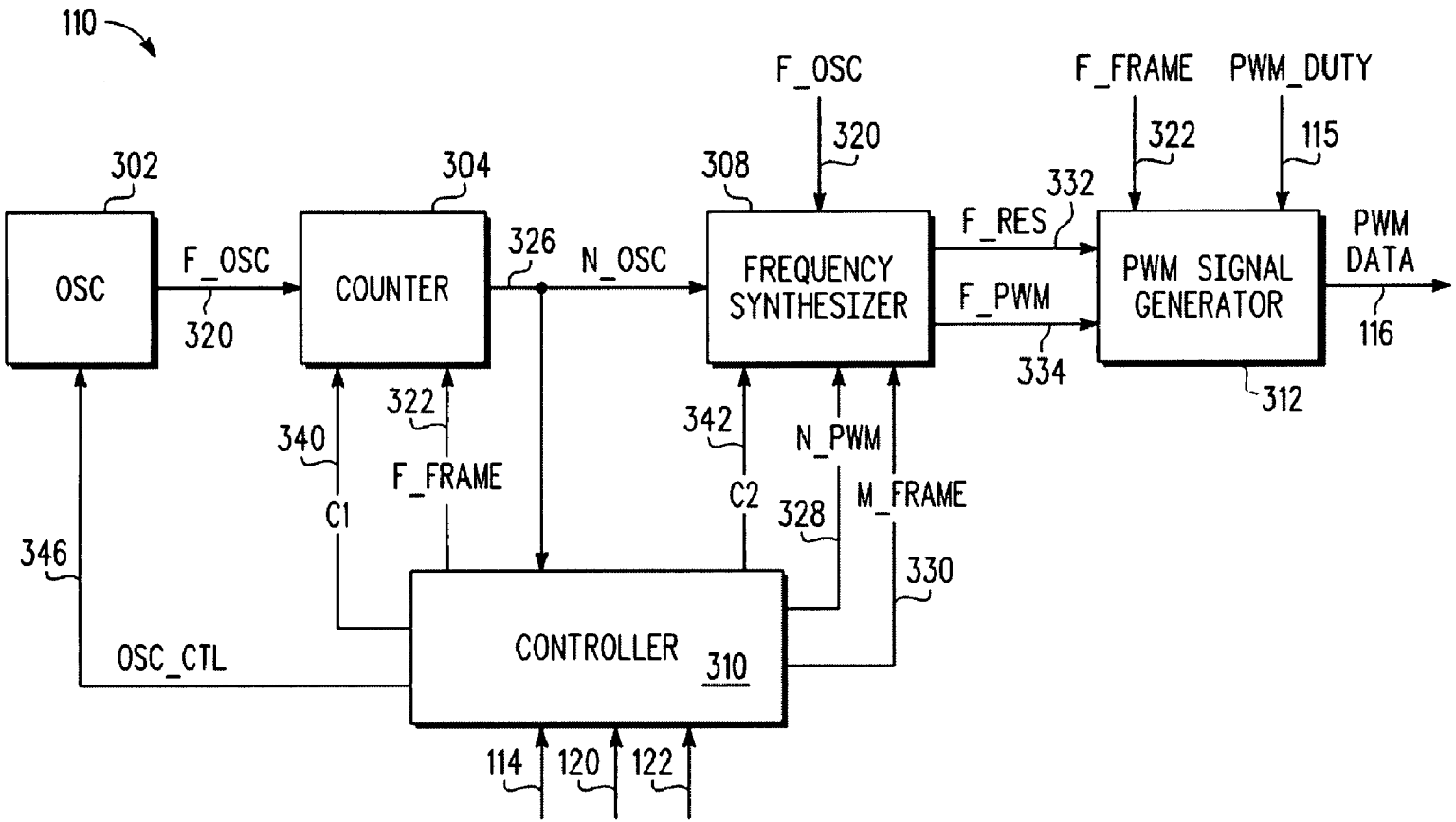
FIG. 3 is a diagram illustrating an example implementation of a frame-synchronized PWM generation module of the LED system of FIG. 1 in accordance with at least one embodiment of the present invention.

FIG. 3 illustrates an example implementation of the frame-sync PWM generation module 110 of FIG. 1 and FIGS. 4-6 illustrate example methods of its operation in accordance with at least one embodiment of the present disclosure. In the example of FIG. 3, the frame-sync PWM generation module 110 includes an oscillator 302 or other periodic signal source, a counter 304, a frequency synthesizer 308, a controller 310, and a PWM signal generator 312. The oscillator 302 is configured to output a clock signal 320 having a frequency f_osc. The counter 304 receives the clock signal 320 and a frame signal 322. The frame signal 322 has a frequency f_frame equal to the frame rate of the video content being displayed. Thus, the frame signal 322 is representative of the timing of the frames of the video content. The counter 304 is configured to count the number of oscillations of the clock signal 320 within a frame (as marked by the frame signal 322) and provide the counted number of oscillations as an oscillation count n_osc (signal 326).

The frequency synthesizer 308 receives the oscillation count n_osc, the clock signal 320, an indicator 328 of the resolution number of PWM duty ratio (n_pwm) (e.g., n_pwm=255 ($2^8-1$) for a PWM duty ratio represented by an 8-bit value), and an indicator (330) of an initial number of PWM cycles expected to occur during a frame (m_frame). From these inputs, the frequency synthesizer 308 generates two signals: a PWM duty resolution frequency signal 332 having a PWM duty resolution frequency (f_res); and a PWM frequency signal 334 having a PWM frequency (f_pwm). Alternatively, the frequency synthesizer 308 can provide the resolution number of the PWM duty ratio (n_pwm) to the PWM signal generator 312 for generating the PWM frequency signal 334 (f_pwm). An example method of generating these two signals is described below with reference to FIG. 4.

The PWM signal generator 312 receives the PWM duty resolution frequency signal 332, the PWM frequency signal 334, the frame signal 322, and the PWM duty data 115. From these inputs, the PWM signal generator 312 generates the PWM data signal 116 such that a new PWM cycle is started at each of the frame boundaries, and such that any incompleteable PWM cycle at the end of a frame is implemented in the PWM data signal 116 as a constant reference level for its duration until terminated by the frame boundary.

Further, in at least one embodiment, the PWM signal generator 312 is configured to implement a self-learning process to dynamically determine the number of completeable PWM cycles that occur during a frame and adjust the process of generating the PWM data signal 116 accordingly. This self-learning process allows the PWM signal generator 312 to adapt to dynamic changes in the operating parameters of the LED system 100, including, but not limited to, changes in frame rate, changes to the PWM cycle frequency, and changes in the frequency f_osc of the oscillator 302, etc. An example method for generating the PWM data signal 116 from these inputs is described with respect to FIG. 6.

The controller 310 is configured to receive the frame timing reference 114 and the oscillation count n_osc (signal 326) and is further configured to provide the frame signal 322, the indicator 328 of the resolution number of PWM duty ratio (n_pwm), and the indicator 330 of number of PWM cycles expected to occur during a frame (m_frame). The controller 310 further provides control signal 340 (C1) to control the operation of the counter 304, control signal 342 (C2) to control the operation of the frequency synthesizer 308, a control signal (not shown) to control the operation of the PWM signal generator 312, and a control signal 346 (osc_ctl) to control the operation of the oscillator 302. In one embodiment, the controller 310 is configured to provide the frame timing reference 114 directly as the frame signal 322. Alternately the controller 310 can derive the frame signal 322 from the frame timing reference 114. The controller 310 can determine the indicator 330 (m_frame) from the PWM frequency indicator 120. As noted above, the PWM frequency indicator 120 can be set via, for example, a programmable register or other storage device that stores a value representative of the desired number of PWM cycles per second, or via the voltage generated via a variable programmable resistor or fuse configured to indicate the desired number of PWM cycles per second. The controller 310 can determine the indicator 328 (n_pwm) from, for example, the PWM resolution indicator 122. Alternately, the controller 310 can be hardwired to provide a predetermined value for the indicator 328.

Figure 4:
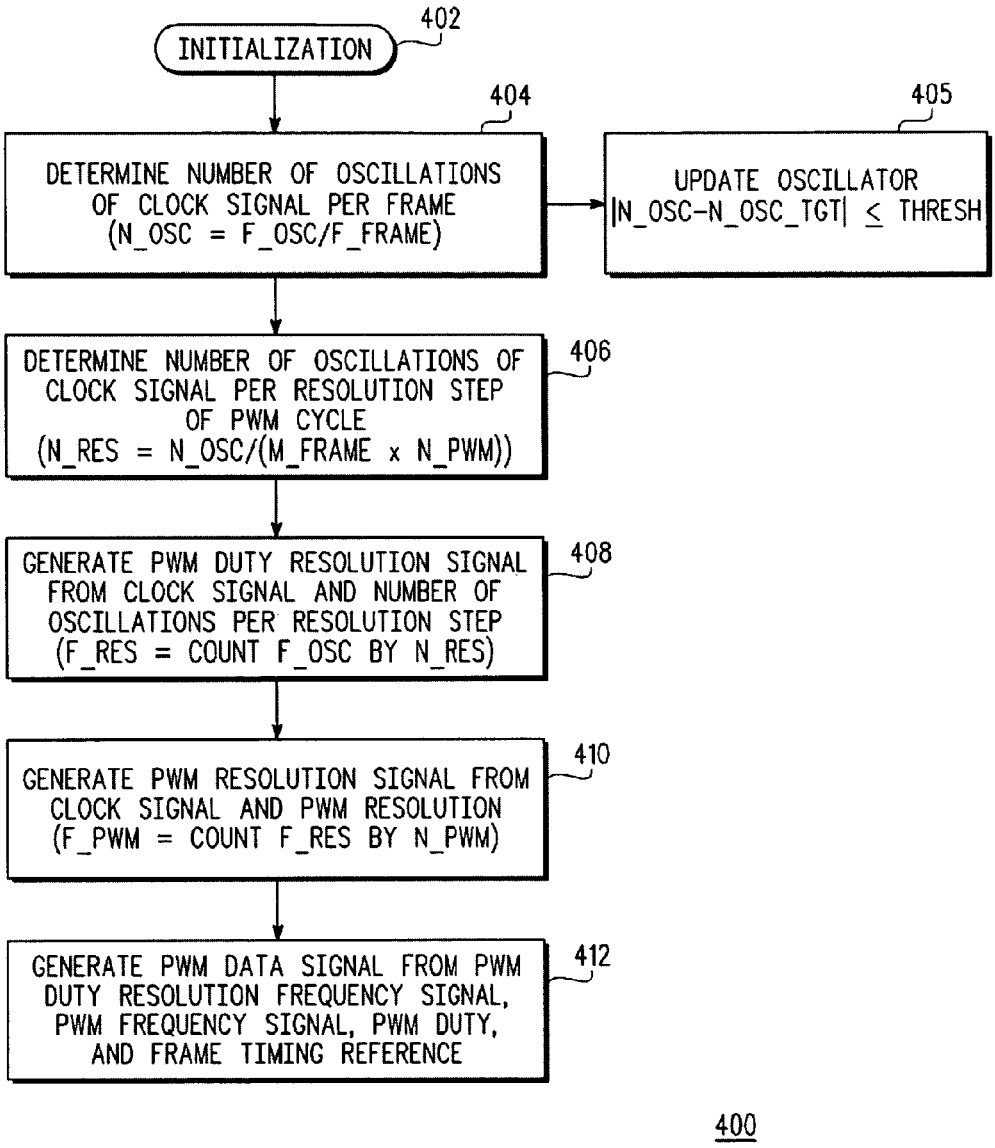
FIG. 4 is a flow diagram illustrating an example method for generating reference signals for generating a PWM data signal in accordance with at least one embodiment of the present invention.

FIG. 4 illustrates an example method 400 of operation of the frame-sync PWM generation module 110 of FIG. 3 in generating the PWM data signal 116 in accordance with at least one embodiment of the present disclosure. Although the method 400 is illustrated as a sequence of process blocks for ease of discussion, it will be appreciated from the description below that the method 400 is a continuous process whereby the process represented by one block is continuously operating using the current states of the signaling resulting from the previous blocks.

At block 402, an initialization event (e.g., a power-on reset) occurs, in response to which the controller 310 initializes the components of the frame-sync PWM generation module 110 by, for example, resetting counters, resetting the indicators to their initial or starting values, and the like.

At block 404, the counter 304 determines the number of oscillations of the clock signal 320 per frame by counting oscillations of the clock signal 320 between pairs of frame boundaries indicated by the frame signal 322 (i.e., n_osc=f_osc/f_frame) and provides the counted oscillations per frame as the oscillation count n_osc. To illustrate, for an oscillator frequency of 600 kHz and a frame rate of 60 frames per second (fps), the number of oscillations per frame would be 10000 oscillations per second (n_osc=10000=600 kHz/60 fps).

At block 405, the controller 310 can adjust (via control signal 346) the oscillator 302 for improved frequency control by comparing the absolute value of the difference between the oscillation count n_osc to a predetermined target oscillation count n_osc_tgt and adjusting the frequency of the oscillator 302 until the difference between the two is not greater than a threshold.

At block 406, the frequency synthesizer 308 determines the number of oscillations of the clock signal 320 per resolution step of the PWM cycles (n_res) using the oscillation count n_osc, the indicator 330 of the number of PWM cycles per frame (m_frame), and the indicator 328 of the resolution number of the PWM duty ratio (n_pwm) (i.e., n_res=n_osc/(m_frame×n_pwm). To illustrate, for an_oscillation count of 10000 (n_osc), 10 PWM cycles per frame (m_frame), and a PWM resolution of eight bits (n_pwm=255 steps ($2^8-1$)), the number of oscillations of the clock signal 320 per resolution step would be approximately 3.92 (n_res=3.92=10000/(10×255). In at least one embodiment, the frequency synthesizer 308 determines or uses only the integer portion of the determined value for n_res (e.g., n_res=integer(3.92)=3 in the above example).

At block 408, the frequency synthesizer 308 generates the PWM duty resolution frequency signal 332 having the PWM duty resolution frequency (f_res) using the clock signal 320 and the number of oscillations per resolution step (n_res) determined at block 406. In one embodiment, the PWM duty resolution frequency signal 332 is generated from the output of a counter (not shown) that counts the oscillations of the clock signal 320 by n_res (i.e., f_res=count f_osc by n_res).

At block 410, the frequency synthesizer 308 generates the PWM frequency signal 334 having the PWM frequency (f_pwm) based on the PWM duty resolution frequency signal 332 and the indicator 328 of the resolution number of the PWM duty ratio (n_pwm). In one embodiment, PWM frequency signal 334 is generated from the output of a counter (not shown) that counts the PWM duty resolution frequency signal 332 by the resolution number of the PWM duty ratio (n_pwm)(i.e., f_pwm=count f_res by n_pwm).

Figure 5:
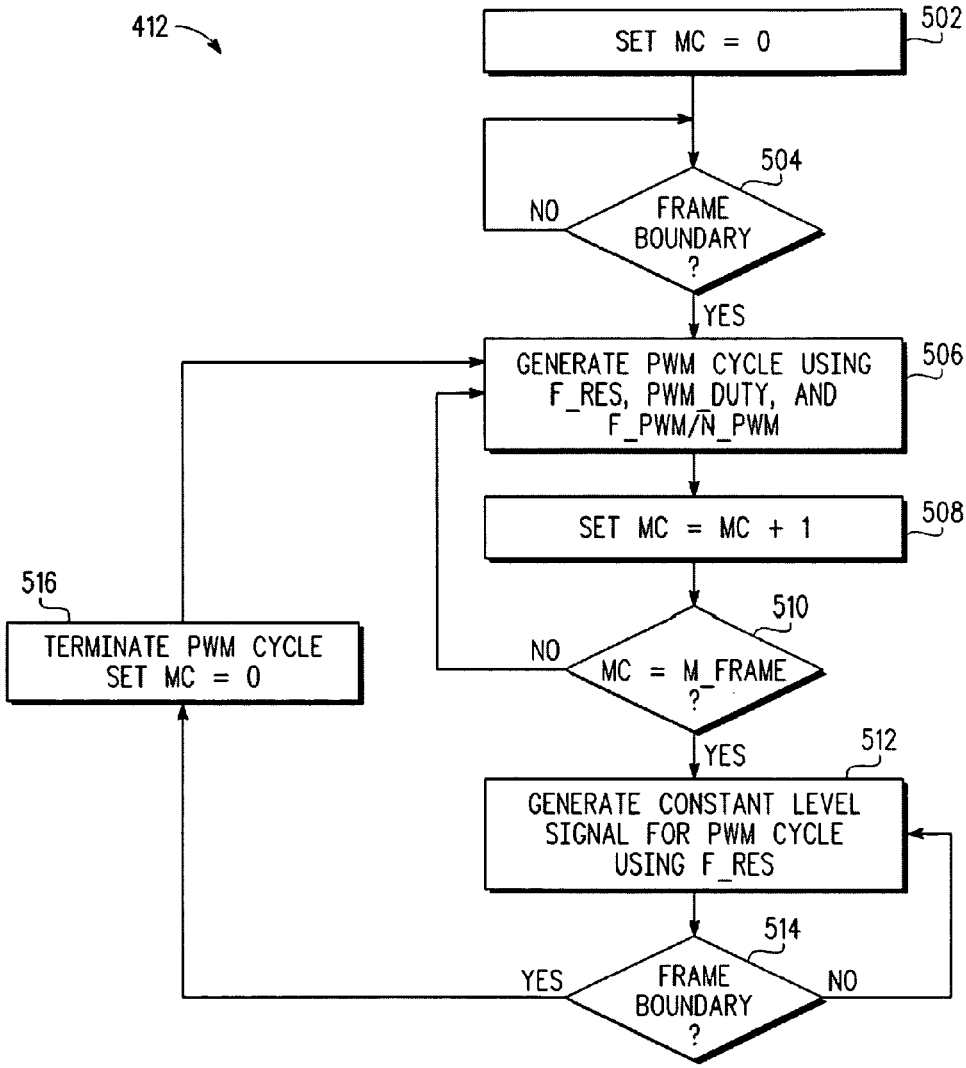
FIG. 5 is a flow diagram illustrating an example method for generating a PWM data signal in accordance with at least one embodiment of the present invention.
Figure 6:
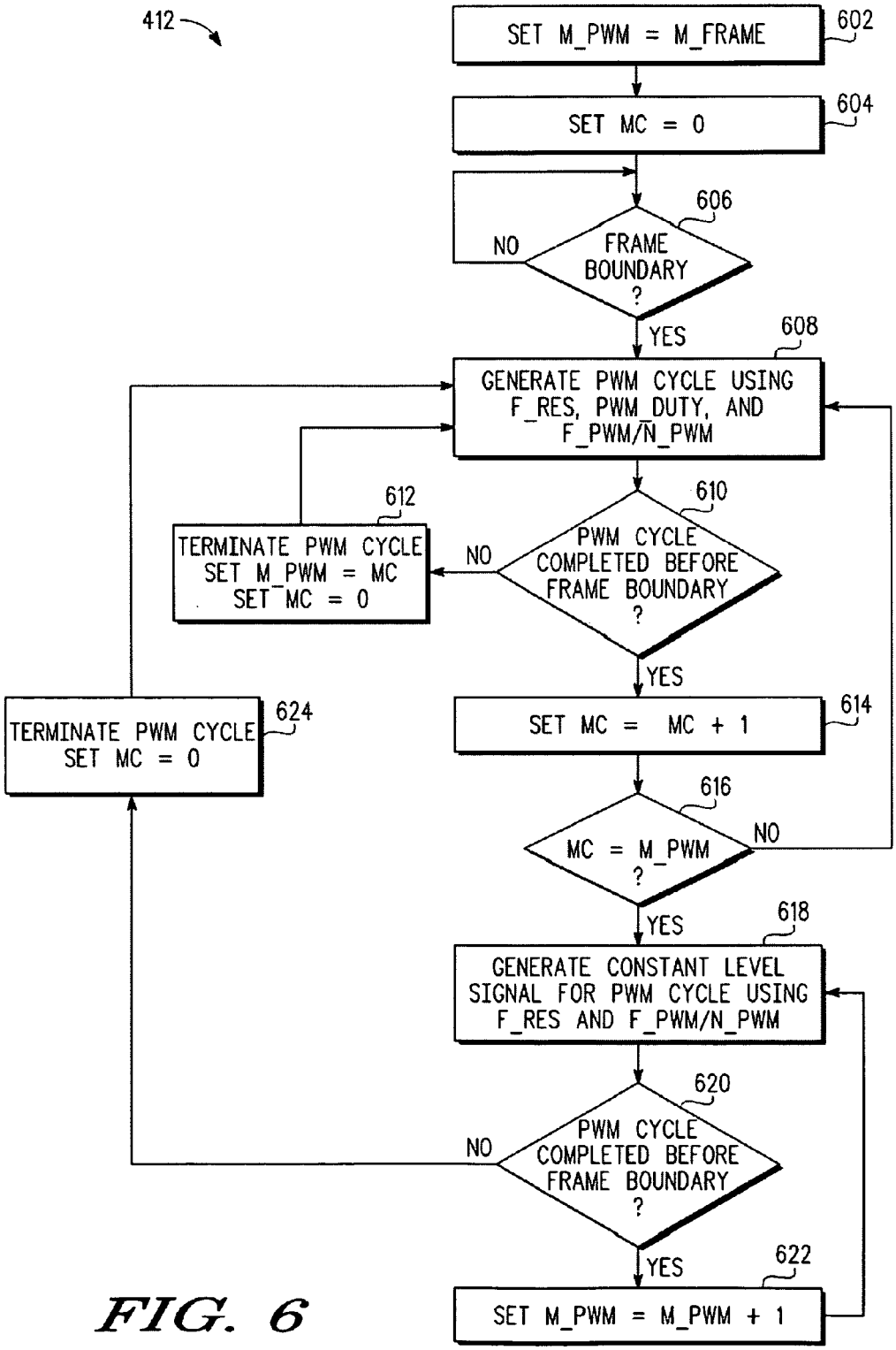
FIG. 6 is a flow diagram illustrating another example method for generating a PWM data signal in accordance with at least one embodiment of the present invention.

At block 412, the PWM signal generator 312 uses the PWM duty resolution frequency signal 332, the PWM frequency signal 334, the PWM duty ratio (PWM_duty) identified by the PWM duty data 115, and the frame signal 322 to generate the PWM data signal 116 having PWM cycles synchronized to the frame boundaries and with incompleteable PWM cycles driven at a constant reference level until their termination. Alternatively, the PWM signal generator 312 can use the indicator 328 (n_pwm) in place of the PWM frequency signal 334 in generating the PWM data signal 116. FIGS. 5 and 6 illustrate examples of the process performed by the PWM signal generator 312 using these inputs to generate one or more PWM data signals 116 in parallel. The resulting one or more PWM data signals 116 are provided to the LED driver 112 (FIG. 1) to control one or more corresponding LED strings of the LED panel 106 (FIG. 1).

FIG. 5 illustrates an example implementation of the process of block 412 of FIG. 4 for generating the PWM data signal 116 in accordance with at least one embodiment of the present disclosure. As described below, the PWM data signal generation process of FIG. 5 employs the above-described technique of driving the PWM data signal 116 at a constant reference level for the incompleteable PWM cycles occurring at frame boundaries.

For the process described below, the PWM data signal generator 312 utilizes variable mc. As noted above, the variable m_frame represents the number of completeable PWM cycles expected to occur in a frame. The variable mc represents a current count of completed PWM cycles during a frame, and which is used to determine whether the expected number of completeable PWM cycles is reached.

In response to being set to an initial state by the controller 310, at block 502 the PWM signal generator 312 sets the variable mc to zero (0) (i.e., mc=0). At block 504, the PWM signal generator 312 uses the frame signal 322 to determine whether a frame boundary has occurred. When a frame boundary is detected, at block 506 the PWM signal generator 312 generates a PWM duty cycle for the PWM data signal 116 using the PWM frequency signal 334, which demarks in time the duration of the PWM cycle being generated, the PWM duty resolution frequency signal 332, which demarks in time each of the resolution steps of the PWM cycle duration (e.g., 255 steps for an 8-bit resolution), and the PWM duty data 115, which signals how many resolution steps of the PWM cycle the PWM data signal is to be driven at a high reference level, with the remaining resolution steps of the PWM cycle being driven at the low reference level (or vice versa). Upon completion of the PWM cycle, the PWM signal generator 312 increments the variable mc by 1 (i.e., mc=mc+1) at block 508 to reflect the completion of another PWM cycle during the current frame.

At block 510, the PWM signal generator 312 compares the variable mc to m_frame to determine whether the expected number of completeable PWM cycles have been completed in the current frame. If the number of completed PWM cycles in the current frame is not equal to the number of expected completeable PWM cycles for a frame (i.e., mc=m_frame), the process returns to block 506 for the generation of the next completeable PWM cycle for the frame. Otherwise, the expected number of completeable PWM cycles has been generated for the current frame, and thus at block 512 the PWM signal generator 312 drives the PWM data signal 116 at a constant reference level to generate a constant-level PWM cycle on the PWM data signal 116 until the next frame boundary is identified at block 514. In response to the frame boundary, at block 516 the PWM signal generator 312 terminates the constant-level PWM cycle and resets the variable mc to zero. The process then returns to block 506 for the next frame. As illustrated by the process of FIG. 5, the generation of the constant-level PWM cycle for the incompleteable PWM cycle occurring prior to a frame boundary can yield a linear average light intensity across frames, thereby reducing display distortion.

FIG. 6 illustrates another example implementation of the process of block 412 of FIG. 4 for generating the PWM data signal 116 in accordance with at least one embodiment of the present disclosure. As described below, the PWM data signal generation process of block 412 employs both the constant-level PWM cycle as described in FIG. 5 and a self-learning process so as to adapt the PWM cycle synchronization process to changes in one or more of the frame rate, the PWM cycle frequency, the oscillation signal of the clock signal 320, and the like. For this self-learning process, the PWM data signal generator 312 utilizes variables m_pwm and mc.

In this example, the variable m_pwm represents the number of completeable PWM cycles expected to occur in a frame and which is increased or decreased when the actual number of completed PWM cycles in a frame is greater than or less than the expected number, respectively. The variable mc represents a current count of completed PWM cycles during a frame, and which is used to determine whether the expected number of completeable PWM cycles is equal to the actual number.

In response to being set to an initial state by the controller 310, at block 602 the PWM signal generator 312 sets the variable m_pwm to the initial number of completeable PWM cycles expected per frame as represented by m_frame (i.e., m_pwm=m_frame). At block 604, the PWM signal generator 312 sets the variable mc to zero (0) (i.e., mc=0).

At block 606, the PWM signal generator 312 uses the frame signal 322 to determine whether a frame boundary has occurred. When a frame boundary is detected, at block 608 the PWM signal generator 312 generates a PWM duty cycle for the PWM data signal 116 using the PWM frequency signal 334, the PWM duty resolution frequency signal 332, and the PWM duty data 115.

While the PWM cycle is being generated on the PWM data signal 116, at block 610 the PWM signal generator 312 monitors the frame signal 322 to determine whether the PWM cycle being generated has completed before the next frame boundary. In other words, the PWM signal generator 312 determines whether the PWM cycle is to be a completed PWM cycle or an incompleteable PWM cycle. That a PWM cycle does not complete when it is expected to complete indicates that actual number of completed PWM cycles (as represented by the current value of mc) within a frame is less than the expected number of completeable frames for the frame (as represented by m_pwm). Accordingly, in the event that the PWM cycle did not complete before the frame boundary (i.e., it is an incompleteable PWM cycle), at block 612 the PWM signal generator 312 sets the variable m_pwm to the current value of the variable mc (i.e., m_pwm=mc) so as to set the expected number of PWM cycles per frame to the determined actual number of PWM cycles detected in the current frame and the PWM signal generator 312 resets the variable mc to zero. Further, the PWM signal generator 312 terminates generation of the current PWM signal and the process returns to block 608 for the next frame using the updated count of expected completeable PWM cycles represented by the updated value of the variable m_pwm.

Otherwise, if the PWM cycle completes before the frame boundary (i.e., the PWM cycle is a completed PWM cycle), at block 614 the PWM signal generator 312 increments the variable mc (i.e., mc=mc+1) to reflect that another PWM cycle has completed within the frame. At block 616, the PWM signal generator 312 determines whether the number of completed PWM cycles within the current frame is equal to the expected number of completeable PWM cycles (i.e., whether mc=m_pwm). If not equal, then at least one more completeable PWM cycle is expected for the current frame and thus the process returns to block 608 for generation of the next PWM cycle for the frame. Otherwise, if the actual number of completed cycles is equal to the expected number, it is expected that the next PWM cycle will be incompleteable due to an upcoming frame boundary. Accordingly, at block 618 the PWM signal generator 312 drives a constant-level PWM cycle on the PWM data signal 116 until the frame boundary is reached.

While driving the PWM data signal 116 at the constant reference level for the constant-level PWM cycle, at block 620 the PWM signal generator 312 uses the PWM duty resolution frequency signal 332 and one of the PWM frequency (f_pwm) or the resolution number of the PWM duty ratio (n_pwm) to determine whether it has been driving the PWM data signal 116 at the constant reference level for the duration of the constant-level PWM cycle. In other words, the PWM signal generator 312 determines whether the constant-level PWM cycle completed before the frame boundary. A completion of the constant-level PWM cycle before the frame boundary indicates that the actual number of completeable PWM cycles in the frame is greater than the expected number. In this event, at block 622 the PWM signal generator 312 increments m_pwm to reflect an increase in the expected number of completeable PWM cycles in a frame and the process returns to block 618 for generation of another constant-level PWM cycle until the frame boundary occurs. Otherwise, if the constant-level PWM cycle is not completed by the frame boundary, at block 624 the PWM signal generator 312 terminates the constant-level PWM cycle in response to the frame boundary and resets the variable mc to zero. The process then returns to block 608 for the next frame using the updated expected number of completeable PWM cycles per frame as represented by the value of the variable m_pwm.

As the process of FIG. 6 illustrates, the PWM signal generator 312 uses an expected number of completeable PWM cycles to determine when to drive a constant-level PWM cycle in expectation of an upcoming frame boundary that will prematurely terminate the constant-level PWM cycle. Further, the PWM signal generator 312 self-learns through the variables m_pwm and mc so as to adjust the number of expected completeable PWM cycles per frame to changes in the actual number of completeable PWM cycles per frame resulting from changes in frame rate or other changes.

Other embodiments, uses, and advantages of the disclosure will be apparent to those skilled in the art from consideration of the specification and practice of the invention disclosed herein. The specification and drawings should be considered exemplary only, and the scope of the invention is accordingly intended to be limited only by the following claims and equivalents thereof.

What is claimed is:

1. A method comprising:

generating a pulse width modulation (PWM) data signal, the PWM data signal comprising:

a first sequence of PWM cycles having a first predetermined duty ratio, an initial PWM cycle of the first sequence being synchronized to a start of a display of a first frame of a video data at a display device, wherein the PWM data signal transitions from a first level to a second level during each PWM cycle;

a first portion of the PWM data signal starting in the first frame following the first sequence of PWM cycles and terminating responsive to a start of display of a second frame of the video data at the display device, the second frame following the first frame, the first portion having a level matching the second level for the duration of the first portion, the duration of the first portion different than the duration of a PWM cycle of the first sequence of PWM cycles; and a second sequence of PWM cycles, an initial PWM cycle of the second sequence being synchronized to the start of the second frame; and providing the PWM data signal to a light emitting diode (LED) driver for control of one or more LEDs of the display device.

2. The method of claim 1, wherein generating the PWM data signal further comprises generating the PWM data signal comprising:

a second portion of the PWM data signal starting in the second frame following the second sequence of PWM cycles and terminating responsive to a start of a display of a third frame following the second frame, the second portion having a level matching the second level for the duration of the second portion, the duration of the second portion different than the duration of a PWM cycle of the second sequence of PWM cycles, the second sequence of PWM cycles having a second predetermined duty ratio.

3. The method of claim 2, wherein generating the PWM data signal comprises:

determining a first number of completeable PWM cycles expected to occur during the display of the first frame;

responsive to the start of the display of the first frame, driving the first sequence of PWM cycles on the PWM data signal by driving PWM cycles having the first predetermined duty ratio and incrementing a first count for each completed PWM cycle of the first sequence until the first count is equal to the first number of completeable PWM cycles;

responsive to the first count being equal to the first number of completeable PWM cycles, driving the PWM data signal at the second level until detecting the start of the display of the second frame;

responsive to determining the duration of the first portion exceeds the duration of the PWM cycle of the first sequence of PWM cycles, increasing a second number of completeable PWM cycles expected to occur during the display of the second frame; and responsive to determining the duration of the second portion is less than the duration of the cycle of the second sequence of PWM cycles, maintaining the second number of completeable PWM cycles at the same number.

4. The method of claim 3, further comprising:

responsive to the start of the display of the second frame, driving the second sequence of PWM cycles on the PWM data signal by driving PWM cycles having the second predetermined duty ratio and incrementing a second count for each driven PWM cycle until the second count is equal to the second number of completeable PWM cycles; and responsive to the second count being equal to the second number of completeable PWM cycles expected to occur during the display of the second frame, driving the PWM data signal at the second level until the start of the display of the third frame.

5. The method of claim 2, wherein generating the PWM data signal comprises:

determining a first number of completeable PWM cycles expected to occur during the display of the first frame;

responsive to the start of the display of the first frame, driving the first sequence of PWM cycles on the PWM data signal by driving PWM cycles having the first predetermined duty ratio and incrementing a first count for each driven PWM cycle until an occurrence of one of: the first count being equal to the first number of completeable PWM cycles; or the display of the first frame terminating before the first count is equal to the first number of completeable PWM cycles;

responsive to the count being less than the first number of completeable PWM cycles at the start of the second frame, decreasing a second number of completeable PWM cycles expected to occur during the display of the second frame;

responsive to the start of the display of the second frame, driving the second sequence of PWM cycles on the PWM data signal by driving PWM cycles having the second predetermined duty ratio and incrementing a second count for each driven PWM cycle until the second count is equal to the second number of completeable PWM cycles; and responsive to the second count being equal to the second number of completeable PWM cycles, driving the PWM data signal at the second level until detecting the start of the display of the third frame.

6. The method of claim 1, wherein generating the PWM data signal further comprises:

determining a first number of completeable PWM cycles expected to occur during a display of a third frame, the display of the third frame prior to the display of the first frame;

responsive to the start of the display of the third frame, driving PWM cycles having a second predetermined duty ratio and incrementing a first count for each completed PWM cycle until the start of the first frame, the first count being less than the first number of completeable PWM cycles at the start of the first frame;

responsive to the first count being less than the first number of completeable PWM cycles, decreasing a second number of completeable PWM cycles expected to occur during the display of the first frame;

responsive to the start of the display of the first frame, driving the first sequence of PWM cycles on the PWM data signal by driving PWM cycles having the first predetermined duty ratio and incrementing a second count for each completed PWM cycle of the first sequence until the second count is equal to the second number of completeable PWM cycles; and responsive to the second count being equal to the second number of completeable PWM cycles, driving the PWM data signal at the second level until detecting the start of the display of the second frame.

7. The method of claim 1, wherein generating the PWM data signal comprises:

determining a number of completeable PWM cycles expected to occur during the display of the first frame;

responsive to the start of the display of the first frame, driving the first sequence of PWM cycles on the PWM data signal by driving PWM cycles having the first predetermined duty ratio and incrementing a count for each driven PWM cycle until the count is equal to the number of completeable PWM cycles; and responsive to the count being equal to the number of completeable PWM cycles, driving the PWM data signal at the second level until detecting the start of the display of the second frame.

8. The method of claim 1, further comprising:

generating a clock signal;

determining a PWM frequency signal based on the clock signal and a frame timing reference representative of a timing of a series of frames of the video data, the PWM frequency signal representative of a timing of the PWM cycles of the first sequence synchronized to the display of the first frame; and wherein driving the PWM cycles having the first predetermined duty ratio comprises driving the PWM cycles based on the PWM frequency signal.

9. The method of claim 8, further comprising:

determining a PWM duty resolution signal based on the clock signal and the frame timing reference, the PWM duty resolution signal representative of a timing of PWM resolution steps of the PWM cycles of the first sequence synchronized to the display of the first frame; and wherein driving the PWM cycles having the first predetermined duty ratio comprises driving the PWM cycles based on the PWM duty resolution signal.

10. In a display device comprising a light emitting diode (LED) driver configured to control one or more LEDs of the display device based on a pulse width modulation (PWM) data signal, a method comprising:

determining a frame timing reference associated with a display of a series of frames of video data at the display device;

driving, for a first frame of the series of one or more frames, a first sequence of pulse width modulation (PWM) cycles on the PWM data signal, the first sequence synchronized to a start of the first frame based on the frame timing reference and the first sequence comprising a first predetermined number of PWM cycles, wherein the PWM data signal transitions from a first level to a second level during each PWM cycle;

driving, for the first frame, the PWM data signal at the second level for a first duration responsive to determining the first predetermined number of PWM cycles have been driven for the first frame, the first duration different than the duration of a PWM cycle of the first sequence of PWM cycles;

terminating driving the PWM data signal at the second level responsive to a start of a second frame of the series of frames, the second frame following the first frame in the series; and driving, for the second frame, a second sequence of PWM cycles on the PWM data signal, the second sequence synchronized to a start of the second frame based on the frame timing reference and the second sequence comprising a second predetermined number of PWM cycles.

11. The method of claim 10, further comprising:

driving, for the second frame, the PWM data signal at the second level responsive to determining the second predetermined number of PWM cycles have been driven for the second frame; and terminating driving the PWM data signal at the second level responsive to a start of a third frame of the series of frames, the third frame following the second frame in the series.

12. The method of claim 11, wherein the first predetermined number of PWM cycles and the second predetermined number of PWM cycles comprise the same number of PWM cycles.

13. The method of claim 11, further comprising:

increasing the first predetermined number of PWM cycles to generate the second predetermined number of PWM cycles responsive to determining the PWM data signal was driven at the second level for the first frame for a duration greater than the duration of a PWM cycle of the second sequence.

14. The method of claim 11, further comprising:

generating a PWM frequency signal from a clock signal and the frame timing reference, the PWM frequency signal representative of a timing of the PWM cycles of the first sequence synchronized to the display of the first frame; and determining the duration of each PWM cycle of the second sequence based on the PWM frequency signal.

15. A system comprising:

a pulse width modulation (PWM) generation module comprising an output configured to be coupled to a light emitting diode (LED) driver of a display device, the PWM generation module configured to generate a PWM data signal for output to the LED driver, the PWM data signal comprising:

a first sequence of PWM cycles having a first predetermined duty ratio, an initial PWM cycle of the first sequence being synchronized to a start of a display of a first frame of a video data. wherein the PWM data signal transitions from a first level to a second level during each PWM cycle;

a first portion of the PWM data signal starting in the first frame following the first sequence of PWM cycles and terminating responsive to a start of a display of a second frame of the video data at the display device, the second frame following the first frame, the first portion having a level matching the second level for the duration of the first portion, the duration of the first portion different than the duration of a PWM cycle of the first sequence of PWM cycles; and a second sequence of PWM cycles, an initial PWM cycle of the second sequence being synchronized to the start of the second frame.

16. The system of claim 15, the PWM generation module further is configured to generate the PWM data signal as further comprising:

a second portion of the PWM data signal starting in the second frame following the second sequence of PWM cycles and terminating responsive to a start of a display of a third frame following the second frame, the second portion having a level matching the second level for the duration of the second portion, the duration of the second portion different than the duration of a PWM cycle of the second sequence of PWM cycles, the second sequence of PWM cycles having a second predetermined duty ratio.

17. The system of claim 16, wherein the PWM generation module further is configured to:

increase a number of PWM cycles to be implemented in the second sequence of PWM cycles responsive to determining the duration of the first portion is greater than the duration of the PWM cycle of the first sequence.

18. The system of claim 15, wherein the PWM generation module comprises:

a counter comprising an input to receive a clock signal and an output to provide a first signal representative of a number of oscillations of the clock signal per frame of the video data;

a frequency synthesizer configured to generate a second signal and a third signal based on the first signal, a first indicator representative of an expected number of completeable PWM cycles per frame of the video data, and a second indicator representative of a duty resolution of the PWM cycles in the first sequence, the second signal representative of a timing of the PWM cycles of the first sequence synchronized to the display of the first frame, and the third signal representative of a timing of PWM resolution steps of the PWM cycles of the first sequence synchronized to the display of the first frame.

19. The system of claim 18, wherein the PWM generation module further comprises:

a PWM signal generator configured to generate the PWM data signal based on the second signal, the third signal, a third indicator representative of a duty ratio of the PWM cycles of the first sequence, and a frame signal representative of a timing of frames of the video data.

20. The system of claim 15, further comprising:

the LED driver; and the display device.

* * * * *